US012071208B2

(12) United States Patent
Boks et al.

(10) Patent No.: US 12,071,208 B2
(45) Date of Patent: Aug. 27, 2024

(54) SYSTEM AND PERIPHERAL DEVICES FOR A MARINE VESSEL

(71) Applicant: Brunswick Corporation, Mettawa, IL (US)

(72) Inventors: Michael J. Boks, Grand Rapids, MI (US); John Witte, Ada, MI (US); Christopher C. Bostwick, Rockford, MI (US)

(73) Assignee: Brunswick Corporation, Mettawa, IL (US)

( * ) Notice: Subject to any disclaimer, the term of this patent is extended or adjusted under 35 U.S.C. 154(b) by 599 days.

(21) Appl. No.: 17/227,959

(22) Filed: Apr. 12, 2021

(65) Prior Publication Data

US 2021/0371064 A1 Dec. 2, 2021

Related U.S. Application Data

(60) Provisional application No. 62/704,874, filed on Jun. 1, 2020.

(51) Int. Cl.
*B63B 79/40* (2020.01)
*B63B 21/04* (2006.01)
(Continued)

(52) U.S. Cl.
CPC ..... *B63B 79/40* (2020.01); *B63B 21/04* (2013.01); *B63B 45/02* (2013.01); *B63B 45/04* (2013.01); *B63B 79/10* (2020.01); *B63B 79/00* (2020.01)

(58) Field of Classification Search
CPC ..... B63B 45/02; B63B 79/10; B63B 79/00; B63B 43/18; B63B 49/00; B63B 17/00;
(Continued)

(56) References Cited

U.S. PATENT DOCUMENTS 2,002,251 A 5/1935 Sensiba
2,749,969 A 6/1956 Tatter
(Continued)

FOREIGN PATENT DOCUMENTS

CN 201525307 U 7/2010
CN 205524875 U 8/2016
(Continued)

OTHER PUBLICATIONS

Dock Edge Solar LED Light Dock Cleat, webpage, available at https://www.basspro.com/shop/en/dock-edge-solar-led-light-dock-cleat, last accessed Nov. 23, 2020, pp. 12-13.
(Continued)

*Primary Examiner* — Mohammad Ali
*Assistant Examiner* — Dhruvkumar Patel
(74) *Attorney, Agent, or Firm* — Andrus Intellectual Property Law, LLP

(57) ABSTRACT

A system for a marine vessel includes a peripheral device having an actuator configured to move part of the peripheral device between a retracted position and an extended position. A first serial bus is configured to connect the peripheral device to other peripheral devices. A controller is operatively connected to the actuator and is in signal communication with the first serial bus. A sensor is coupled to the controller via a second serial bus. The controller is configured to activate the actuator to move the part of the peripheral device from the extended position to the retracted position and from the retracted position to the extended position in response to information from the sensor.

19 Claims, 7 Drawing Sheets

(51) Int. Cl.

| | |
|---|---|
| ***B63B 45/02*** | (2006.01) |
| ***B63B 45/04*** | (2006.01) |
| ***B63B 79/00*** | (2020.01) |
| ***B63B 79/10*** | (2020.01) |

(58) Field of Classification Search
CPC . B63B 69/00; B63B 2017/0054; B63B 45/04; B63B 59/02; G08G 3/02
See application file for complete search history.

(56) References Cited

U.S. PATENT DOCUMENTS 3,395,544 A 8/1968 Fisher, Sr.
3,588,816 A 6/1971 Himes
3,624,629 A 11/1971 Donaldson
3,839,757 A 10/1974 Grimes
4,055,845 A 10/1977 Ladrick
4,126,820 A 11/1978 Hormann et al.
4,928,620 A 5/1990 Currey
4,977,848 A 12/1990 Currey
4,990,836 A 2/1991 Nakase et al.
5,097,188 A 3/1992 Nakase et al.
5,111,383 A 5/1992 Kimura
5,216,972 A 6/1993 Dufrene et al.
5,304,993 A 4/1994 Handsaker
5,383,640 A 1/1995 Johnson
5,521,442 A 5/1996 Butterfield et al.
5,525,844 A 6/1996 Doolittle, III et al.
5,636,884 A 6/1997 Ladetto
5,833,385 A 11/1998 Carnahan
5,975,508 A 11/1999 Beard
6,038,996 A 3/2000 Giles
6,057,787 A 5/2000 Kell et al.
6,116,183 A 9/2000 Crow
6,138,973 A 10/2000 Woodward
6,204,753 B1 3/2001 Schenk et al.
6,273,771 B1 8/2001 Buckley et al.
6,450,845 B1 9/2002 Snyder
6,481,973 B1 11/2002 Struthers
6,542,077 B2 4/2003 Joao
6,586,890 B2 7/2003 Min
6,788,195 B1 9/2004 Stegman
6,901,875 B1 * 6/2005 Beal ..... B63B 17/04 410/107
6,940,026 B2 9/2005 Rundell
6,963,177 B2 11/2005 Ito
6,968,796 B1 11/2005 Burke
7,017,872 B2 3/2006 Hogle
7,303,236 B2 12/2007 Ritter
7,331,305 B2 2/2008 Garelick
7,355,518 B1 4/2008 Staerzl
7,364,234 B2 4/2008 Begin
7,461,995 B2 12/2008 Burnley
7,474,203 B2 1/2009 Urick
7,490,905 B2 2/2009 Ritter
7,525,507 B1 4/2009 Henry, Jr.
7,535,375 B2 5/2009 McDermott, Sr.
7,686,397 B2 3/2010 Sahi
7,794,124 B2 9/2010 Hulsey
7,798,669 B2 9/2010 Trojanowski
7,866,751 B2 1/2011 Downey
7,938,377 B2 5/2011 Draghici
8,025,431 B1 9/2011 Burke
8,113,892 B1 2/2012 Gable
8,292,368 B1 10/2012 Yarbrough
8,368,560 B2 2/2013 McDonald
8,444,203 B2 5/2013 Ohtsubo
8,474,910 B2 7/2013 Kaemmerer
8,499,495 B2 8/2013 Houser
8,590,971 B2 11/2013 Ito
8,757,851 B1 * 6/2014 Clemons ..... B63B 45/04 362/418
8,864,232 B2 10/2014 Hashimoto
8,996,210 B2 3/2015 Kish et al.
9,056,659 B2 6/2015 Adair
9,078,328 B2 7/2015 Anand
9,120,410 B2 9/2015 Bauman
9,233,645 B2 1/2016 Schofield
9,242,703 B2 1/2016 Nutz
9,328,727 B2 5/2016 Koehl
9,399,415 B2 7/2016 Serber
9,410,545 B2 8/2016 Nirenberg
9,480,534 B2 11/2016 Bowling
9,481,466 B2 11/2016 Fischer
9,528,567 B2 12/2016 Robbins
9,604,550 B2 3/2017 Ito
9,604,707 B2 3/2017 Falck
9,630,527 B2 4/2017 Matsui
9,655,458 B2 5/2017 Jacobs
9,681,510 B2 6/2017 Van De Ven
9,908,597 B1 3/2018 Benson
9,925,892 B2 3/2018 Frye
9,927,520 B1 3/2018 Ward et al.
9,950,809 B2 4/2018 Breban
10,005,380 B2 6/2018 Reid
10,086,728 B2 10/2018 White
10,150,471 B2 12/2018 Funk
10,155,477 B1 12/2018 Mclean, Jr.
10,260,566 B2 4/2019 Salerno
10,328,826 B2 6/2019 Ramachandra
10,377,281 B2 8/2019 Pleskot
10,532,673 B2 1/2020 Kemp
10,745,091 B1 8/2020 Tate et al.
10,752,139 B2 8/2020 Plante
10,773,613 B2 9/2020 Nakamura
11,681,040 B2 6/2023 Harper
2003/0197601 A1 10/2003 Takagi et al.
2004/0016241 A1 1/2004 Street
2006/0091654 A1 5/2006 Mersseman et al.
2007/0154322 A1 7/2007 Stiles
2008/0179478 A1 7/2008 Lee
2009/0126615 A1 * 5/2009 Strong ..... B63B 21/04 114/218
2009/0208345 A1 8/2009 Moore
2010/0305789 A1 12/2010 Ito
2011/0118998 A1 5/2011 Loose et al.
2012/0080866 A1 * 4/2012 West ..... B60D 1/015 280/476.1
2012/0119681 A1 * 5/2012 Seidl ..... H05B 47/195 315/362
2013/0039081 A1 2/2013 Czipri et al.
2013/0134196 A1 5/2013 Lee
2014/0188359 A1 7/2014 Chen
2014/0196652 A1 * 7/2014 Adair ..... B63B 45/00 362/477
2016/0097393 A1 4/2016 Hartman
2016/0107727 A1 * 4/2016 Nachem ..... B63B 21/04 114/230.1
2016/0268669 A1 9/2016 Wilcox
2017/0066512 A1 * 3/2017 Arditi ..... B63B 59/02
2017/0080831 A1 3/2017 Kaemmerer
2017/0106791 A1 4/2017 Li
2017/0158130 A1 6/2017 Patil
2017/0158136 A1 6/2017 Solache
2017/0175746 A1 6/2017 Mayleben
2017/0259729 A1 9/2017 Balasundrum
2018/0072384 A1 3/2018 Von Mueller
2018/0262131 A1 9/2018 Russick
2018/0335788 A1 * 11/2018 Behling ..... B63H 20/10
2019/0263480 A1 * 8/2019 Potts, I ..... B63B 21/24
2019/0331778 A1 10/2019 Runciman et al.
2019/0341671 A1 11/2019 Conrad
2020/0108902 A1 * 4/2020 Wong ..... B63H 25/02
2020/0164798 A1 5/2020 Cardimen
2021/0221283 A1 7/2021 Yudelevich
2021/0344102 A1 * 11/2021 Swar ..... H01Q 1/32

FOREIGN PATENT DOCUMENTS

CN 108177733 A 6/2018
CN 208264514 U 12/2018
CN 111007790 A 4/2020
DE 202005006903 U1 8/2006

(56) References Cited

FOREIGN PATENT DOCUMENTS

| | | | |
|---|---|---|---|
| EP | 1026036 | A2 | 8/2000 |
| EP | 1434186 | B1 | 2/2007 |
| EP | 2247161 | A1 | 11/2010 |
| EP | 3919366 | A1 | 12/2021 |
| JP | 5095350 | B2 | 12/2012 |
| WO | WO 2015010270 | A1 | 1/2015 |
| WO | 2017004419 | A1 | 1/2017 |
| WO | WO 2017004419 | A1 | 1/2017 |

OTHER PUBLICATIONS

Accon Marine, "Pop-Up Lights," webpage, available at https://shop.acconmarine.com/category/5-pop-up-lights.aspx, last accessed Nov. 30, 2020.
Aqua Signal, "Aqua Signal 24600-7 Deck-Mount Bi-Color Light with Tell-Tell Indicator," webpage, available at https://www.amazon.com/Aqua-Signal-Stainless-Hideaway-Navigation/dp/B001B012CS, last accessed Nov. 30, 2020.
Seadog Line, "LED Pop-Out Combination Bow Light," webpage, available at https://sea-dog.com/groups/4046-led-pop-out-combination-bow-light, last access Nov. 30, 2020.
Attwood Marine, "Stainless Steel Pop-Up Neat Cleats," webpage, available at https://www.westmarine.com/buy/attwood--4-1-2-stainless-steel-pop-up-neat-cleat--P024_723_001_507, last accessed Nov. 30, 2020.
Search Report Issued in European Application No. 21175918.8, dated Oct. 29, 2021, 9 pages.
Springfield Marine Company, "Plug-InTM Series," webpage, available at www.springfieldgrp.com/products/plug-in-series, last visited Nov. 16, 2020, pp. 23-24.
Power Products, LLC, "CZONE," brochure, Sep. 2019.
Quora Inc., "Why don't cars have a dash board warning light alerting you when a taillight or headlight is out? You normally don't know until you get pulled over by a cop. Even if you check them before each trip they sometimes burn out while on the trip." Quora thread, at least as early as Aug. 31, 2017.
Jian-Yue et al., "Design of Vehicle Lamp Control System based on LIN bus," paper presented at 4th National Conference on Electrical, Electronics and Computer Engineering (NCEECE), 2015, Shanghai, China.
Cervi et al., "Omnibus Interior Lighting System Using LEDs and Automotive Communication Network," journal article published in Revista Controle & Automação, April, May, and Jun. 2006, pp. 205-212, vol. 17 No. 2, Santa Maria, Brazil.
Bovill et al., "Bilge Pump Systems," U.S. Appl. No. 16/952,515, filed Nov. 19, 2020 (specification and drawings only).
Witte et al., "Seating System and Seat Assembly for Marine Vessel," U.S. Appl. No. 17/227,963, filed Apr. 12, 2021 (specification and drawings only).
Witte et al., "Plug-in Seating System for Marine Vessel," U.S. Appl. No. 17/227,973, filed Apr. 12, 2021 (specification and drawings only).
T-Matix GMBH, "Connect IT Boat," webpage, available at https://www.connect-it-boat.com/?lang=en, last visited May 13, 2021.
Siren Marine, LLC, "Peace of Mind for Boaters," webpage, available at https://sirenmarine.com/pages/how-it-works?gclid=EAIaIQobChMIpMezrvrG8AIV8PbjBx1_WAcREAAYASABEgJ0AfD_BWE, last visited May 13, 2021.
Stein, Ben, "Innovative Electronics Like Navico ID Hardly Mentioned, a New Paradigm?", web article on Soundings Online, Mar. 13, 2019, available at https://www.soundingsonline.com/news/navico-panbo, last visited May 13, 2021.
Witte et al., "System for a Marine Vessel," U.S. Appl. No. 17/326,843, filed(specification, claims, and drawings only).
Taco Marine, "Grand Slam 850 Electric VHF Antenna Mount," website, available at https://tacomarine.com/electronics-store-gs-850-2, last visited Apr. 20, 2021.
E-Riggers, "Electric Antenna Mount," website, available at http://www.e-riggers.com/our-story.html, last visited Apr. 20, 2021.
E-Riggers, "Electric Anchor Light," website, available at http://www.e-riggers.com/services.html, last visited Apr. 20, 2021.
Office Action in corresponding Chinese Patent Application No. 202110598276.4, dated Jun. 20, 2024, 12 pages, and English translation, 11 pages.

* cited by examiner

SYSTEM AND PERIPHERAL DEVICES FOR A MARINE VESSEL

CROSS-REFERENCE TO RELATED APPLICATION

This application claims the benefit of U.S. Provisional Application No. 62/704,874, filed on Jun. 1, 2020, which is hereby incorporated by reference herein.

FIELD

The present application relates to systems for marine vessels, and more specifically to systems for controlling peripheral devices on board a marine vessel and to such peripheral devices themselves.

BACKGROUND

U.S. Pat. No. 9,927,520 discloses a method of detecting a collision of a marine vessel, which includes sensing using distance sensors to determine whether an object is within a predefined distance of a marine vessel, and determining a direction of the object with respect to the marine vessel. The method further includes receiving a propulsion control input at a propulsion control input device and determining whether execution of the propulsion control input will result in any portion of the marine vessel moving toward the object. A collision warning is then generated.

U.S. Pat. No. 10,745,091 discloses a marine navigational light fixture including a light source and a cutoff sub-housing holding the light source. The cutoff sub-housing has a main frame having first and second laterally opposite sides; first and second sidewalls projecting from the first and second sides of the main frame, respectively; and first and second cutoff surfaces located on the first and second sidewalls, respectively. The first and second cutoff surfaces are configured to provide practical cutoff of light emitted from the light source outside of a specified arc of visibility. The marine navigational light fixture also includes a main housing holding the cutoff sub-housing. A luminaire subassembly for the marine navigational light fixture includes a colored component having a color that is in the same color family as a color of light emitted from the luminaire subassembly. The colored component can be a lens, a filter cap, a PCB, and/or a telltale.

The above patents are hereby incorporated herein by reference in their entireties.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

The present disclosure is of a system for a marine vessel, which includes a peripheral device having an actuator configured to move part of the peripheral device between a retracted position and an extended position. A first serial bus is configured to connect the peripheral device to other peripheral devices. A controller is operatively connected to the actuator and is in signal communication with the first serial bus. A sensor is coupled to the controller via a second serial bus. The controller is configured to activate the actuator to move the part of the peripheral device from the extended position to the retracted position and from the retracted position to the extended position in response to information from the sensor.

According to another example of the present disclosure, a peripheral device for a marine vessel includes a movable part configured to be extended away from or out of a stationary part of the peripheral device and retracted toward or into the stationary part. An actuator of the peripheral device is configured to extend and retract the movable part. A controller of the peripheral device is operatively connected to the actuator and is configured to activate the actuator to extend and retract the movable part of the peripheral device in response to information from a sensor. The controller includes a transceiver for receiving information from the sensor via a serial bus.

BRIEF DESCRIPTION OF THE DRAWINGS

Examples of systems for marine vessels and peripheral devices therefor are described with reference to the following Figures. The same numbers are used throughout the Figures to reference like features and like components.

DETAILED DESCRIPTION

Figure 1:
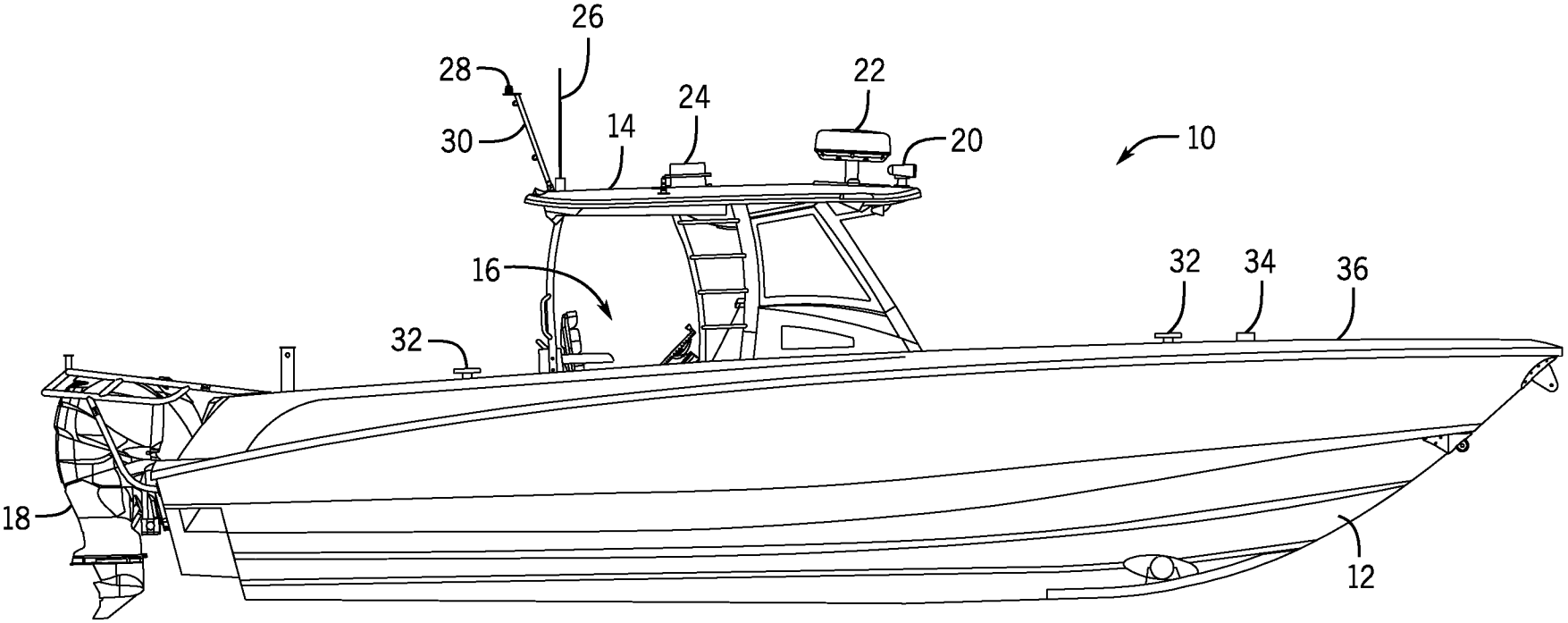
FIG. 1 illustrates one example of a marine vessel according to the present disclosure.

FIG. 1 illustrates one example of a marine vessel 10, generally comprising a hull 12 and a hardtop 14 covering the cockpit area 16. A marine propulsion device 18, such as for example the outboard motor or engine shown here, is configured to produce thrust to propel the marine vessel 10 through water. The hardtop 14 supports a number of peripheral devices, including a camera 20, a proximity sensor 22 such as the radar shown here, a navigation sensor such as the global positioning system receiver 24 shown here, a very high frequency (VHF) antenna 26, and an all-around light 28 supported by a pole 30. Other peripheral devices on the marine vessel 10 include cleats 32 and navigation lights 34 (another is provided on the port side) on the gunwhale 36. It should be understood that the marine vessel 10 may be equipped with any or all of these peripheral devices, and that the size, location, and/or number of such devices may vary depending on the marine vessel 10 in question, the owner's preference, and/or governmental regulations. More specifics of the peripheral devices will be provided herein below.

Now turning to FIG. 2, a system 38 according to the present disclosure will be described. The system 38 includes a serial bus 40, such as a controller area network ("CAN") bus using the NMEA 2000 ("N2K") protocol, which is the communications standard for marine applications. In one example, serial bus 40 is the main CAN bus on the marine vessel 10 to which the helm control module in the cockpit area 16 and the engine/motor control module in the marine propulsion device 18 are connected.

A telematics control module ("TCM") 42 is connected to the serial bus 40. The TCM 42 can relay information from wireless sensors (not shown) located on or near several peripheral devices 46, 50, 66*a-c* to the cloud 44 via any appropriate wireless protocol. From the cloud 44, a user can access the information from the wireless sensors. A digital switching module ("DSM") 49 is also linked to the serial bus 40. The DSM 49 receives inputs from a multi-function display ("MFD") or keypad 51 via the serial bus 40 and/or from one or more buttons or switches (not shown) wired to the DSM 49. In response to the inputs, solid state relays in the DSM 49 are activated or deactivated to control a peripheral device 46 wired to the DSM 49. Additional sensors (not shown) may also be wired to the DSM 49. Information from the wired sensors is transmitted to the serial bus 40 via the DSM 49. Through the serial bus 40, the sensed information can be relayed to the TCM 42 and from there to the cloud 44. The DSM 49 reduces the need to manually wire each peripheral device (e.g., 46) and sensor on the marine vessel 10 to the MFD or keypad 51 in order for the user to be able to control the peripheral device 46 or view information from the sensors. Instead, the DSM 49 can be located remote from the MFD or keypad 51 and connected to the MFD or keypad 51 through the serial bus 40. The DSM 49 is wired to the peripheral device(s) 46 and to the wired sensor(s), which may be located closer to the DSM 49 than to the MFD or keypad 51.

The system 38 also includes at least one peripheral device having a controller integrated therein. Here, two peripheral devices 50, 66*a* are provided with a controller 54, 70*a*, respectively. The system 38 also includes an additional serial bus 58 connected to the controllers 54, 70*a*. In one example, the serial bus 58 may also be a CAN bus using the N2K protocol. The serial bus 58 is linked to the serial bus 40 by way of a gateway or bridge 60, depending on whether the two serial buses 40, 58 use the same protocol. (Note that some marine vessel components use different versions of the NMEA protocol and/or the bus 58 may be a LIN bus.) The additional serial bus 58 may be required due to a limit on the number of nodes on the serial bus 40 and/or to work around physical constraints on the marine vessel 10. Moreover, it may be desirable to provide an initially separate serial bus 58 to connect all peripheral devices noted herein below (e.g., lights, cleats, antennas) as part of a retrofit, as at least some of such devices may not have been connected to a serial bus before, but instead hardwired to switches at the helm or connected to the DSM 49. Such a retrofit serial bus 58 could then be connected to the existing serial bus 40 on the marine vessel 10 by way of the gateway or bridge 60 without having to disturb the connections already made thereto. In another example, the serial buses 40 and 58 are a single bus. Note that although only two peripheral devices 50, 66*a* are shown connected to the serial bus 58, additional peripheral devices could be connected thereto.

As will be described more fully herein below, each peripheral device's controller 54, 70*a* is configured to control switches in the peripheral device 50, 66*a*. For example, the peripheral device 50 and/or 66*a* can be programmed to move in response to weather conditions, geographical location, time of day, ambient lighting conditions, vessel speed, and/or sensed proximity of an object external to the marine vessel 10. Such information can be relayed via the serial bus(es) 40, 58 from an appropriate sensor, as will be described herein below. Such information could additionally or alternatively be information in the cloud 44 collected from other users' prior experiences and could be communicated to the peripheral devices 50, 66*a* via the TCM 42 and serial buses 40, 58. Furthermore, the peripheral devices' controllers 54, 70*a* may be configured to stage the peripheral devices 50, 66*a* upon start-up of the system 38. For example, the peripheral devices' controllers 54, 70*a* can be programmed to move the peripheral devices 50, 66*a* to predetermined positions, turn the peripheral devices 50, 66*a* ON or OFF, or run a sequence of events to test the peripheral devices' functioning upon start-up of the system 38 and/or upon user-input command.

In the present example, at least one of (i.e., one or both of) the peripheral devices 50, 66*a* is a master peripheral device, and the system 38 further includes at least one slave peripheral device 66*b*, 66*c* connected to the master peripheral device 66*a* by an additional serial bus 62. Here, the additional serial bus 62 is a local interconnect network ("LIN") bus, which is generally less expensive than a CAN bus. The controller 70*a* in the master peripheral device 66*a* can be programmed to control the functioning of the master peripheral device 66*a* and/or the functioning of the slave peripheral devices 66*b*, 66*c* in response to information from the other peripheral device 50 on the serial bus 58, information from the sensors described herein below, and/or information from the cloud 44 (via the TCM 42 and serial buses 40, 58). The controller 70*a* will be described more fully herein below with respect to FIG. 3. Note that the peripheral device 50 can also be linked to slave peripheral devices (not shown) and its controller 54 can act as a master controller. Each master controller 54, 70*a* can control the slave peripheral devices connected thereto to move in response to weather conditions, geographical location, time of day, ambient lighting conditions, vessel speed, and/or sensed proximity of an object external to the marine vessel 10 and/or for purposes of staging the marine vessel 10 upon start-up or user-input command.

Note that the DSM 49 does not need to be linked by individual wires to the peripheral devices 50, 66*a* that have controllers 54, 70*a*. Rather, these "smart" peripheral devices 50, 66*a* are activated based on their controllers' own commands, signals from the MFD or keypad 51 via the serial buses 40, 58, signals from each other via the serial bus 58, or a combination of any of these. The DSM 49 can instead be used to control a peripheral device 46 that does not benefit from "smart" functions, such as a horn or windshield washer fluid. The peripheral devices 50, 66*a* have system-agnostic architecture that ensures the peripheral devices' compatibility with alternative vessel systems into which an OEM may choose to integrate these devices, as each device is "plug-and-play" with its own internal controller 54, 70*a*. Device manufacturers can ensure future compatibility with a given vessel's system even when service or replacement is required. Furthermore, because each peripheral device 50, 66*a* computes at the edge, the system 38 can still operate safely if the API network goes down on the marine vessel 10. This is not necessarily the case with solely a central digital switching module-type arrangement.

Figure 2:
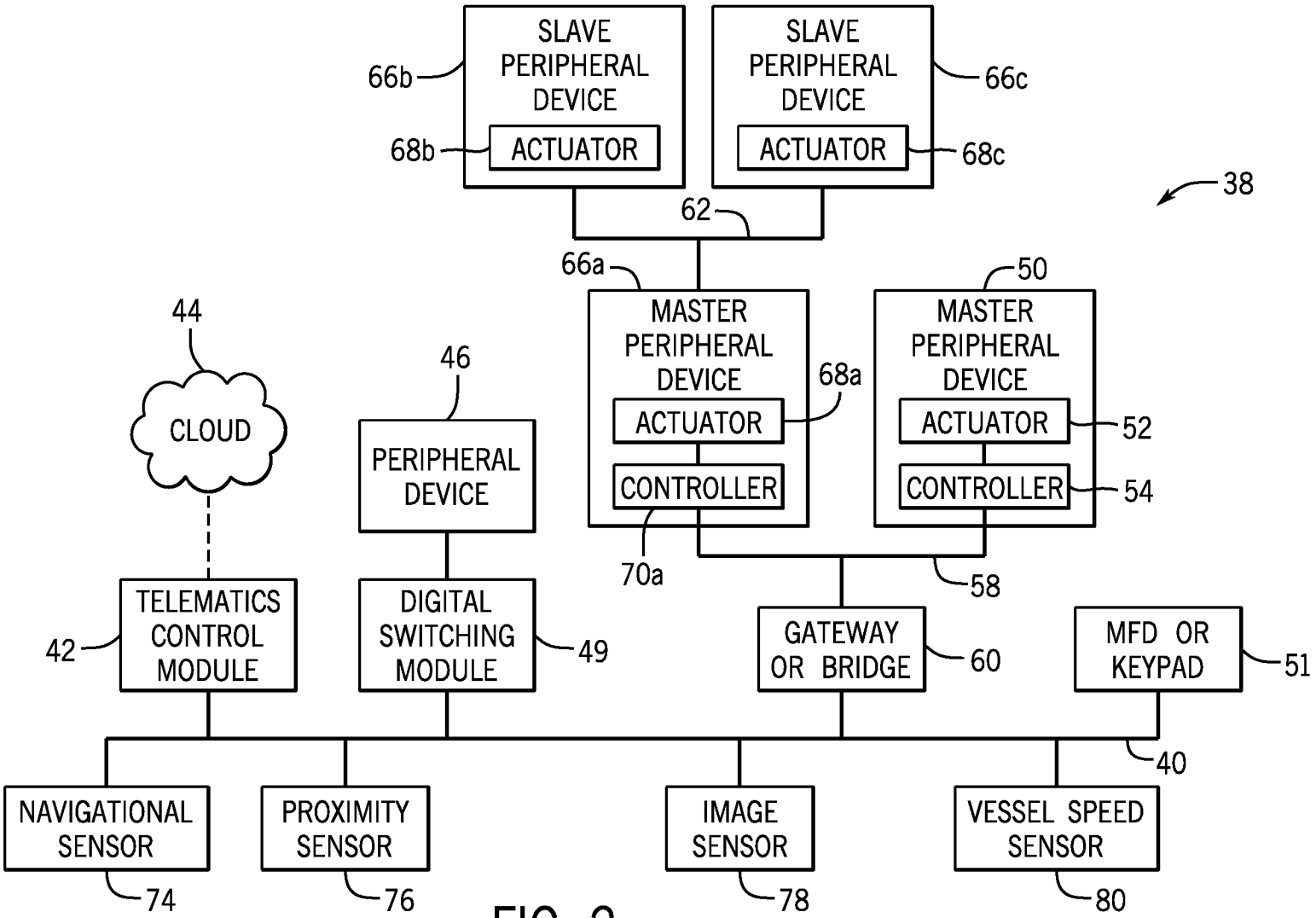
FIG. 2 illustrates an example of a system for a marine vessel according to the present disclosure.

Still referring to FIG. 2, the peripheral device 66*a* has an actuator 68*a* configured to move part of the peripheral device 66*a* between a retracted position and an extended position. The controller 70*a* is operatively connected to the actuator 68*a* and—as noted above—is in signal communication with the serial bus 62, which is configured to connect the peripheral device 66*a* to other peripheral devices 66*b*, 66*c* of the same type. In this example, the controller 70*a* is located on or in the peripheral device 66*a*; however, the controller could be separate from the peripheral device 66*a*, such as in a separate housing or module, and operatively connected to the actuator 68*a* via the serial bus 58 or 62. At least one sensor (e.g., a navigational sensor 74, a proximity sensor 76, an image sensor 78, and/or a vessel speed sensor 80) is coupled to the controller 70*a* via another serial bus. In the example shown, the sensors 74, 76, 78, 80 are coupled to the controller 70*a* via the serial bus 58, the gateway or bridge 60, and the serial bus 40. In other examples, the sensors 74, 76, 78, 80 are connected to the same bus 58 as the peripheral devices 50, 66*a*. In still other examples, some of the sensors 74, 76, 78, 80 are connected to the bus 58 and others are connected to the serial bus 40.

In the example shown, the peripheral devices 66*b*, 66*c* are of the same type as the peripheral device 66*a* (e.g., all peripheral devices 66*a-c* are lights) and each includes an actuator 68*b*, 68*c*coupled to the controller 70*a* via the serial bus 62. Thus, the controller 70*a* acts as a master controller and controls the actuators 68*a*, 68*b*, 68*c*of all peripheral devices. Meanwhile, the peripheral device 50 may be of a different type (e.g., a cleat) than the peripheral devices 66*a-c* and its controller 54 may control its actuator 52 and actuators in other cleats on board the marine vessel 10, to which its controller 54 is connected via another serial bus (not shown).

The navigational sensor 74 can be any type of navigational sensor capable of determining the global position of the marine vessel 10 in latitude and longitude, optionally in addition to the vessel's heading, pitch, roll, and yaw. For example, the navigational sensor 74 can be a GPS receiver like that shown at 24 in FIG. 1. In other examples, the navigational sensor 74 can be, but is not limited to, any type of GNSS device, a differential GPS, a GPS equipped with an inertial measurement unit (IMU), an attitude and heading reference system (AHRS), or a GPS-aided inertial navigation system. Such devices are well known in the art and therefore will not be described further herein. One example of a navigational sensor 74 that would work for the present purposes is Part No. 8M0105389 GPS/IMU KIT, provided by Mercury Marine of Fond du Lac, Wisconsin.

The proximity sensor 76 can be any type of proximity sensor suitable for determining the proximity of an external object with respect to the marine vessel 10. For example, the proximity sensor 76 can be a radar like that shown at 22 in FIG. 1. In other examples, the proximity sensor 76 can be a sonar, laser, lidar, ultrasonic, or infrared sensor. Such devices are well known in the art and therefore will not be described further herein. One example of a radar unit that would work for the present purposes is the Quantum 2 provided by Raymarine of Fareham, United Kingdom. While locating the proximity sensor 76 on the hardtop 14 of the marine vessel 10 will have particular advantages as will be apparent below, the proximity sensor 76 can be located anywhere on the marine vessel 10 suitable for sensing objects external to the marine vessel 10. Multiple proximity sensors of the same or different types can be provided on the marine vessel 10 at different locations in order to sense objects in front of, above, to the sides of, and behind the marine vessel 10.

The image sensor 78 is any image sensor capable of detecting objects external to the marine vessel 10 and thus may also be placed on the hardtop 14 or at the bow of the marine vessel 10. The image sensor 78 may be a charge-coupled device (CCD) or an active-pixel sensor (CMOS) and can be part of an infrared or near-infrared camera. In another example, the image sensor 78 is a microbolometer image sensor as part of a thermal night vision camera. The camera (for example, camera 20, FIG. 1) containing the image sensor 78 can be pivotable and/or rotatable in order to focus on an external object of interest. Examples of cameras with image sensors that would work for the present purposes are the M364C and M364-LR provided by Flir Systems of Wilsonville, Oregon.

The vessel speed sensor 80 is any sensor capable of determining the speed of the marine vessel 10. The vessel speed sensor 80 can be a pitot tube sensor, a paddle wheel sensor, an ultrasonic speed sensor, or an electromagnetic speed sensor. In another example, various readings of geographical position over time from the navigational sensor 74 can be used to calculate the marine vessel's speed over ground. This calculation can be done in the navigational sensor 74 itself or by an external controller. One example of a vessel speed sensor 80 that would work for the present purposes is Part No. 31-606-6-01 provided by Airmar of Milford, New Hampshire.

Through research and development, the present inventors have realized that providing at least some of the peripheral devices on a marine vessel 10 with built-in controllers allows the peripheral devices to provide advanced functionality heretofore not realized with marine peripheral devices. Furthermore, the present inventors realized that providing such peripheral devices' controllers with information from one or more various sensors could be beneficial in that it allows for automating the advanced functionality for such peripheral devices. For example, referring to FIG. 2, the controller 70*a* in the peripheral device 66*a* is configured to activate the actuator 68*a* to move a part of the peripheral device 66*a* from an extended position to a retracted position and from a retracted position to an extended position in response to information from the sensor(s) 74, 76, 78, and/or 80. In the examples described below with respect to FIGS. 4-7, the peripheral device is an antenna, a light, a cleat, or a camera, although other peripheral devices can be actuated in similar manners, as will be apparent to those having ordinary skill in the art.

Figure 4B:
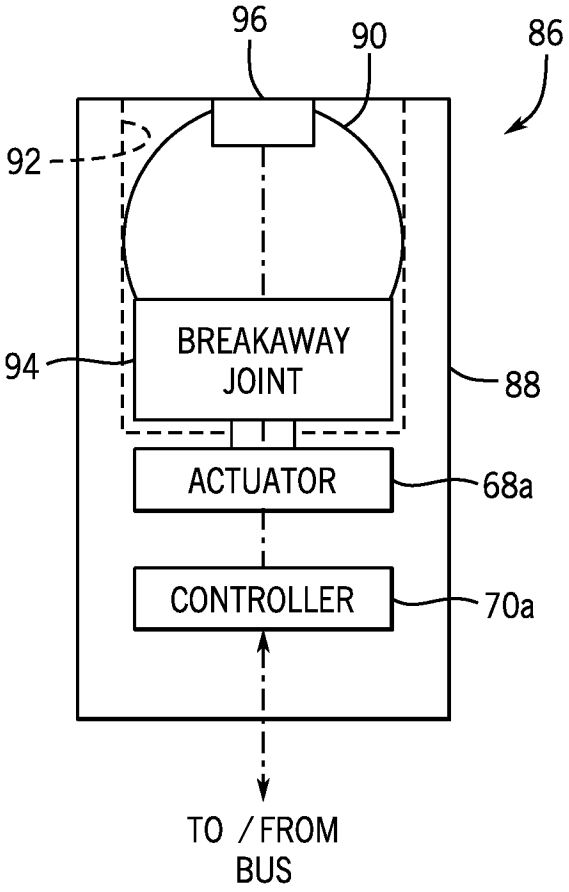
FIG. 4B illustrates the light in a retracted configuration.
Figure 4A:
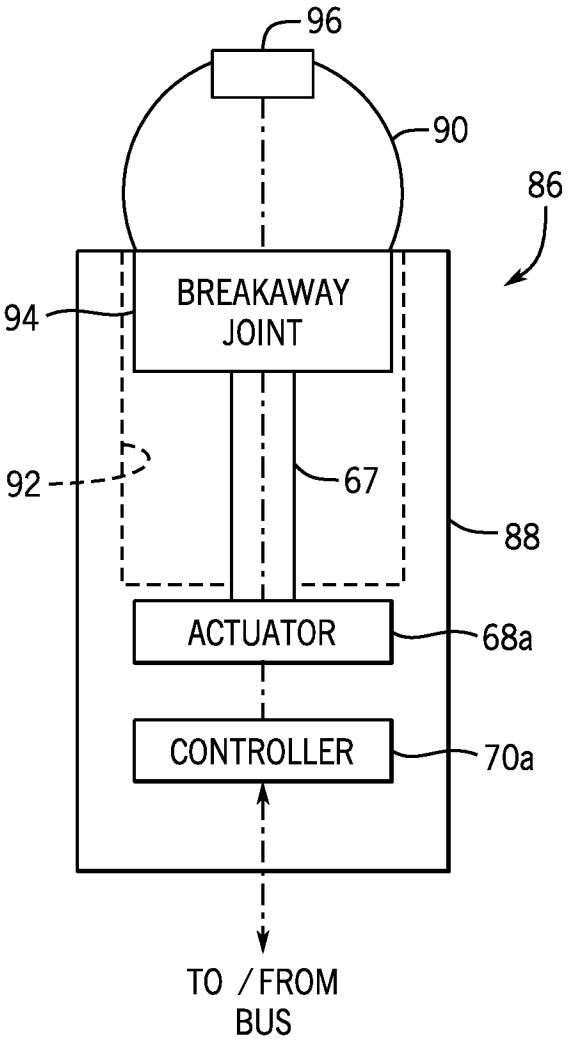
FIG. 4A illustrates a light for a marine vessel in an extended configuration.

FIGS. 4A and 4B show an example in which the peripheral device 66*a* is a light 86. For example, the light 86 can be a navigation light (e.g., a red or green light meant to indicate a particular side of the marine vessel 10, such as light 34 shown in FIG. 1). In another example, the light 86 is an all-around light, a masthead light, or a stern light. The light 86 includes a stationary part 88 and a movable part 90. The stationary part 88 can be a housing recessed into the gunwhale 36, hardtop 14, or other surface of the marine vessel 10. The movable part 90 can be the luminaire portion of the light 86, such as the light engine, lens, filter, and any components supporting or housing same. In one example in which the light 86 is a sidelight, the movable part 90 is substantially similar to the device described in U.S. Pat. No. 10,745,091 incorporated by reference herein above. The stationary housing 88 has a recess 92 into which the movable part 90 can be retracted, as shown in FIG. 4B. From the retracted position, the movable part 90 can be extended from the stationary part 88, as shown in FIG. 4A. Such retraction and extension of the movable part 90 is provided by the actuator 68*a*, which may be a motor (such as a stepper motor or a servo motor), an electro-mechanical actuator, a pneumatic actuator, or a hydraulic actuator, and which may be linear or rotary depending on whether the movable part 90 is designed to move directly up and down with respect to the stationary part 88 or to pivot/rotate into and out of the stationary part 88. If the actuator 68*a* is a motor or an electro-mechanical actuator, current and voltage thereto are controlled directly by the controller 70*a*. If the actuator 68*a* is a pneumatic or hydraulic actuator, the controller 70*a* controls the opening and closing of electrically-operated valves to regulate air or fluid in the actuator 68*a*.

The controller 70*a* can be configured to activate the actuator 68*a* to extend or retract that movable part 90 of the light 86 in response to many different inputs. As noted herein above, one of those inputs can be information from one of the sensors 74, 76, 78, 80 via the serial bus(es) 40 and/or 58. For example, the navigational sensor 74 may provide time-of-day information to the controller 70*a*, which may be configured to extend the movable part 90 out of the housing 88 as dusk approaches and to retract the movable part 90 into the stationary part 88 after sunrise. In other examples, ambient light sensors are provided in connection with the serial bus 40 and/or 58 or are located on the light 86 and directly connected to the controller 70*a*, and the controller 70*a* is configured to extend the movable part 90 when ambient lighting conditions are low and to retract the movable part 90 when ambient light is bright. In some instances, the navigational sensor 74 also provides geographical location to the controller 70*a*, which is configured to extend the movable part 90 if the marine vessel 10 is in the middle of a body of water or if the marine vessel 10 is anchored outside the location of a known dock or marina, in addition to requiring that the time of day be between dusk and dawn or that ambient light be low. The controller 70*a* can determine that the marine vessel 10 is anchored in response to the vessel's GPS position not changing for a predetermined period of time. In some examples, the marine vessel 10 might not even be required to be "on" for the movable party 90 to be extended from the housing 88 and turned ON, and the controller 70*a* may be configured to "wake" the system 38 and extend and turn on the movable part 90 of the light 86 in response to the marine vessel 10 being stationary for longer than a predetermined period of time as dusk approaches or in low ambient light. This may help the boat owner automatically comply with lighting regulations, even when the owner is not present on the marine vessel 10.

The controller 70*a* can be configured to turn on the light 86 whenever the movable part 90 of the light 86 is extended from the stationary part 88 (FIG. 4A), and to turn off the light 86 whenever the movable part 90 of the light 86 is retracted into the recess 92 in the stationary part 88 (FIG. 4B).

As is also shown in FIGS. 4A and 4B, the light 86 includes a breakaway joint 94 between the movable part 90 of the light 86 and the actuator 68*a*. The breakaway joint 94 may be a hinge that allows the movable part 90 of the light 86 to pivot with respect to the stationary part 88 when force above a given threshold is applied laterally to the movable part 90. In another example, the breakaway joint 94 can be a portion of the device between the movable part 90 and the output shaft 67 of the actuator 68*a* that is more frangible than the movable part 90 and the output shaft 67, such that the more frangible breakaway joint 94 will break instead of the less frangible output shaft 67. In yet another example, the breakaway joint 94 can be a ball-in-socket type joint, where one of the ball or socket connected to the movable part 90 is more bendable or breakable than the other of the ball or socket connected to the output shaft 67 of the actuator 68*a*. In all cases, the breakaway joint 94 is configured such that if the movable part 90 of the light 86 is impacted with force above a predetermined threshold, as dictated by the design of the breakaway joint 94, the movable part 90 will pivot or partially or completely break off from the stationary parts of the light 86, such as the stationary part 88 and actuator 68*a*. Thus, if the movable part 90 is impacted, the parts of the light 86 that are likely more expensive and more difficult to replace will remain undamaged. A new movable part 90 can then be installed on the output shaft 67 of the actuator 68*a*.

A contact-sensitive detector 96 may further be provided in communication with the controller 70*a*. The controller 70*a* may be configured to control the actuator 68*a* to retract the movable part 90 of the light 86 in response to the contact-sensitive detector 96 detecting contact while the actuator 68*a* is extending the movable part 90 of the light 86. For example, the contact-sensitive detector 96 can comprise a compressible layered body with an electrical conductor connected to each respective layer. When the body is not compressed, the layers thereof—and thus the electrical conductors—do not touch, and the actuator 68*a* extends the movable part 90 of the light 86 from the stationary part 88 according to input from the controller 70*a* in response to the information from the navigational sensor 74 or ambient light sensor. However, if an external object contacts one layer, that layer and the electrical conductor thereupon compress toward the electrical conductor on the other layer. In response to the resulting current change input to the controller 70*a*, the controller 70*a* controls the actuator 68*a* to stop extending the movable part 90, and to reverse direction to retract the movable part 90 instead. In this way, the movable part 90 will not be fully extended if there is an obstruction present, thus protecting the light 86 from damage, and—if the contact is made with a person—protecting the person from injury. Other known contact-sensitive sensors could be used, such as those on automatic windows in vehicles, including "no-touch" capacitance sensors having layered or coaxial conductive elements separated by a non-conductive layer.

Figure 5B:
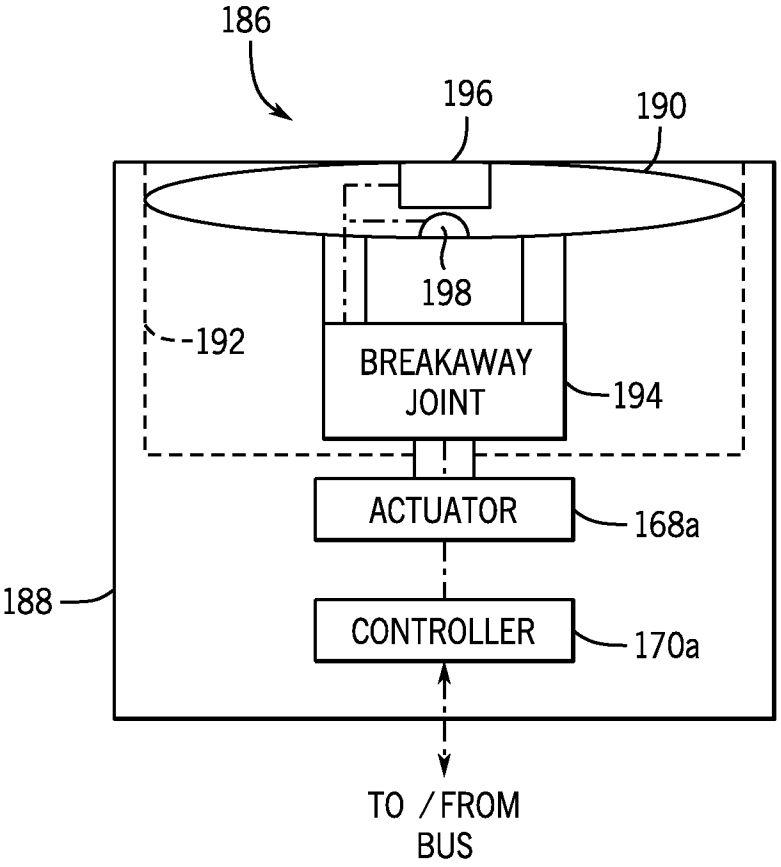
FIG. 5B illustrates the cleat in a retracted configuration.
Figure 5A:
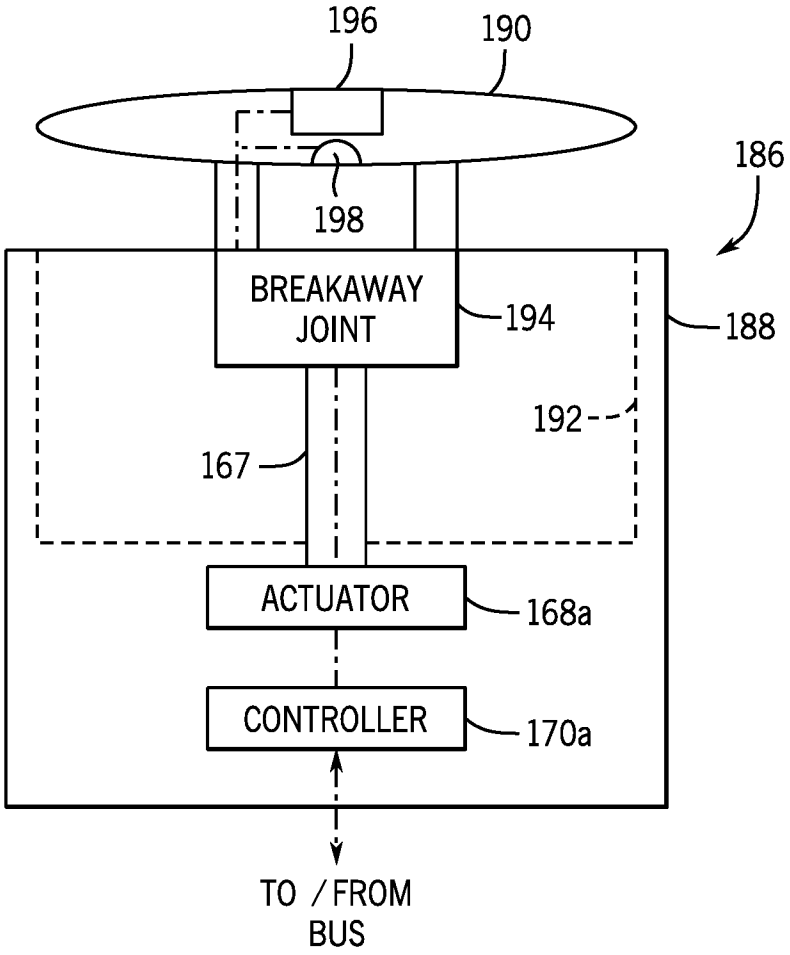
FIG. 5A illustrates a cleat for a marine vessel in an extended configuration.

FIGS. 5A and 5B show another example, in which the peripheral device 66*a* is a cleat 186. The cleat 186 has a movable part 190, which extends and retracts from a recess 192 in a stationary part 188 configured to be installed in the gunwhale 36 of the marine vessel 10. An actuator 168*a* is coupled to the movable part 190 by way of a breakaway joint 194. Note that the breakaway joint 194 is especially useful in a cleat 186, in that if the marine vessel 10 accelerates away from a mooring while the cleat 186 is still attached to the mooring by a rope, the rope will pull the movable part 190 of the cleat 186 away from the stationary part 188 thereof, instead of pulling the entire device out of the gunwhale 36. A contact-sensitive detector 196 is located at the top end of the movable part 190. The actuator 168*a*, breakaway joint 194, movable part 190, and contact-sensitive detector 196 all function substantially similarly to the corresponding components in the light 86 of FIGS. 4A and 4B and will not be described again.

The controller 170*a* is configured to activate the actuator 168*a* to move the movable part 190 of the cleat 186 from the extended position shown in FIG. 5A to the retracted position shown in FIG. 5B and from the retracted position to the extended position in response to information from a sensor. In one example, the sensor is the navigational sensor 74, and the controller 170*a* is configured to activate the actuator 168*a* to extend the movable part 190 of the cleat 186 in response to the navigational sensor 74 sensing that the marine vessel 10 is in a geographical location of a marina or dock. For example, the controller 170*a* may activate the actuator 168*a* to raise the cleat 168 if the marine vessel's current geographical location is within a threshold distance of the known geographical location of a dock/marina or within a given geo-fenced area, which may be stored in the controller 170*a*, in the MFD, or in a chart plotter connected to the serial bus 40 or 58. The controller 170*a* may also require that the navigational sensor 74 previously reported that the marine vessel 10 was in open water before arriving in the geographical area of the dock/marina and/or that the marine vessel 10 has been within the area of the dock/marina for longer than a predetermined period of time (e.g., two minutes) before activating the actuator 168*a* to extend the movable part 190 of the cleat 186. In another example, the sensor is the vessel speed sensor 80, and the controller 170*a* is configured to activate the actuator 168*a* to retract the movable part 190 of the cleat 186 into the recess 192 in the stationary part 188 (see FIG. 5B) in response to the vessel speed sensor 80 sensing a speed of the marine vessel 10 that is above a predetermined threshold speed. For example, the threshold speed may be 10 mph. When the marine vessel 10 is operating at such speeds, the presumption is the operator does not intend to dock the marine vessel 10 imminently, and the cleat 186 is therefore not needed.

In some examples, the cleat 186 comprises a light 198. In this example, the light 198 is shown on the underside of the movable part 190 of the cleat 186 to provide light in the area where a boater would wrap a rope; however, the light could be provided on the top of the movable part 190, on both the top and bottom of the movable part 190, or on the sides thereof. The controller 170*a* can be configured to turn on the light 198 whenever the movable part 190 of the cleat 186 is extended from the stationary part 188 (FIG. 5A), and to turn off the light 198 whenever the movable part 190 of the cleat 186 is retracted into the recess 192 in the stationary part 188 (FIG. 5B). In other examples, the controller 170*a* can use time-of-day information from the navigational sensor 74 or ambient light readings from an ambient light sensor to determine whether the light 198 should be ON or OFF, assuming the movable part 190 of the cleat 186 is extended from the stationary part 188 when such determinations are made. In still other examples, the controller 170*a* could be configured to change the color of the light 198 or to turn one or more lamps/light engines in the light 198 on or off depending on a geographical position of the marine vessel 10 as determined by the navigational sensor 74. For example, if the marine vessel 10 is in open water, the controller 170*a* may be configured to control the light 198 to any color but red or green, which are used for navigational indications. While the marine vessel 10 is in the geographical location of a marina or dock, the controller 170*a* may be configured to control the light 198 to any color, including red or green. This could provide visual interest to those on the marine vessel 10, similar to existing lighted cupholders.

Figure 6B:
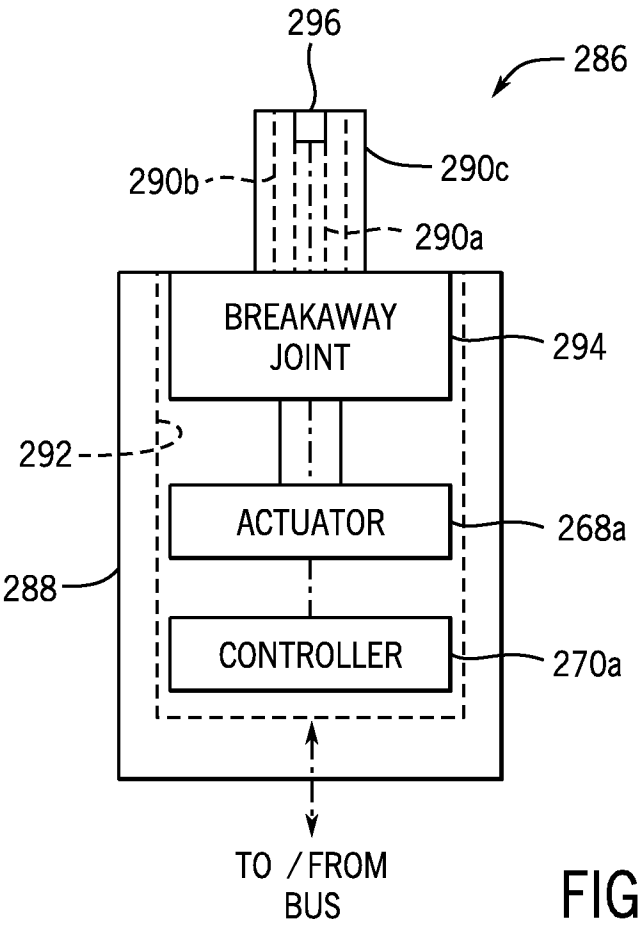
FIG. 6B illustrates the first example of the antenna or light in a retracted configuration.
Figure 6A:
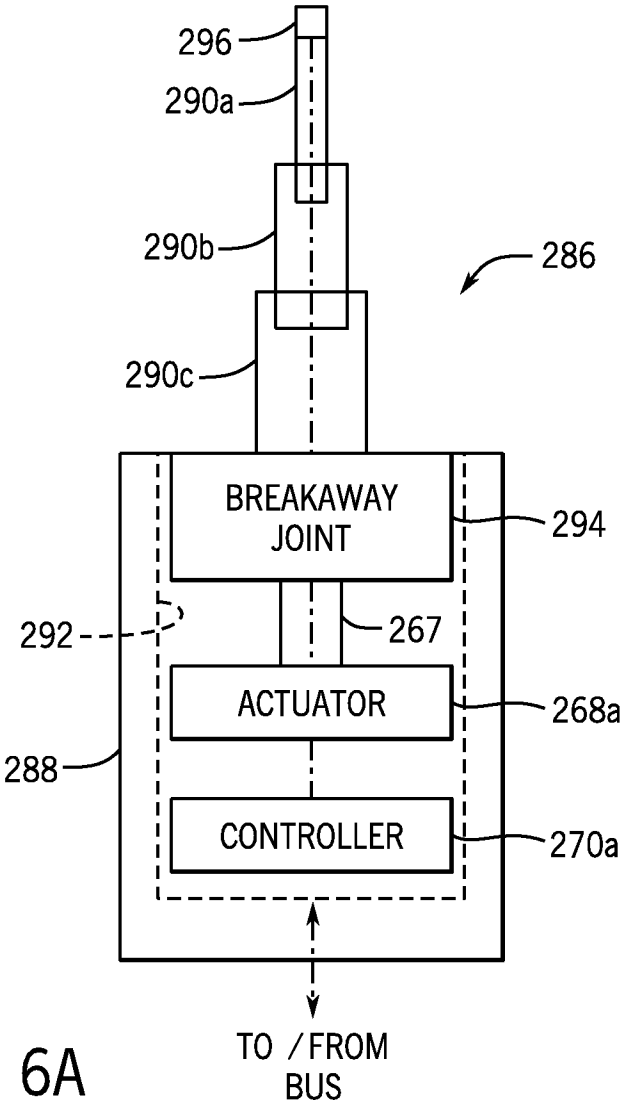
FIG. 6A illustrates a first example of an antenna or light for a marine vessel in an extended configuration.

FIGS. 6A and 6B show an example in which the peripheral device 66*a* is an antenna, a masthead light, or an all-around light 286, which are peripheral devices that are often mounted on the hardtop 14 or other elevated surface (flying bridge, roof, etc.) of the marine vessel 10. The antenna/light 286 includes a movable part, comprised of telescoping movable parts 290*a*, 290*b*, and 290*c*. In the example in which the peripheral device is an antenna, the movable parts 290*a-c* are the antenna itself. Although the details are not shown here, if the peripheral device is an all-around light, the movable parts 290*a-c* are supporting poles, and the light could be mounted at the top of the uppermost movable part 290*a*. An actuator 268*a* is coupled to the movable parts 290*a-c* by way of a breakaway joint 294. The actuator 268*a* can be any of those noted herein above with respect to FIGS. 4A and 4B. In this example, however, the actuator 268*a* may particularly be a telescoping linear actuator, such as a rigid belt or chain actuator. The breakaway joint 294 and contact-sensitive detector 296 at the top of the uppermost movable part 290*a* function substantially similarly to the corresponding parts described herein above and will not be described again.

The controller 270*a* is configured to activate the actuator 268*a* to move the telescoping movable parts 290*a-c* of the antenna/light 286 from the extended position (FIG. 6A) to the retracted position (FIG. 6B) and from the retracted position to the extended position in response to information from a sensor. In one example, the sensor is the proximity sensor 76, and the controller 270*a* is configured to activate the actuator 268*a* to retract the movable parts 290*a-c* of the antenna/light 286 in response to the proximity sensor 76 sensing an obstruction ahead of and above the marine vessel 10. In another example, the sensor is the image sensor 78, and the controller 270*a* is configured to activate the actuator 268*a* to retract the movable parts 290*a-c* of the antenna/light 286 in response to the image sensor 78 sensing an obstruction ahead of and above the marine vessel 10. In still another example, the sensor is the navigational sensor 74, and the controller 270*a* is configured to activate the actuator 268*a* to retract the movable parts 290*a-c* of the antenna/light 286 in response to the navigational sensor 74 sensing that the marine vessel 10 is in a geographical location of a low overhead obstruction, as indicated for example by a geofence, which may be stored in the controller 170*a*, in the MFD, or in a chart plotter connected to the serial bus 40 or 58. Thus, the antenna/light 286 can be lowered before the marine vessel 10 passes under the overhead obstruction, which might otherwise contact and damage the antenna/light 286 due to its height and location on the hardtop 14 or other elevated surface of the marine vessel 10. Notably, some VHF antennas can be up to 18 feet tall, although even more typical 8-foot antennas are susceptible to damage if on an elevated part of the marine vessel 10.

Note that although the example in FIG. 6B shows the movable parts 290*a* and 290*b* retracting into the part 290*c* of the antenna/light 286, in another example, the part 290*c* can also be retracted into the recess 292 in the stationary part 288 of the antenna/light 286, which may be installed on or in the hardtop 14 or other surface of the marine vessel 10.

Figure 7B:
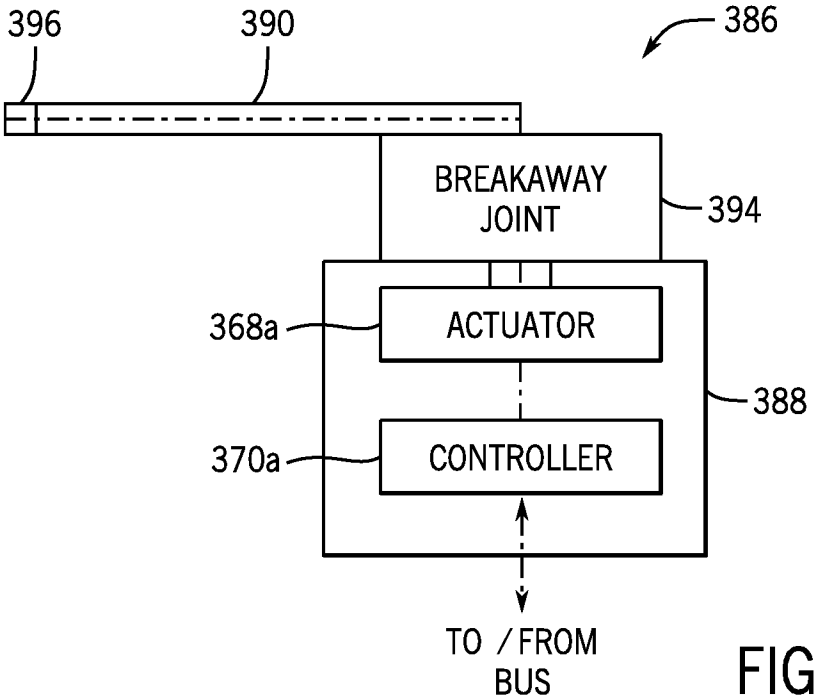
FIG. 7B illustrates the second example of the antenna or light in a retracted configuration.
Figure 7A:
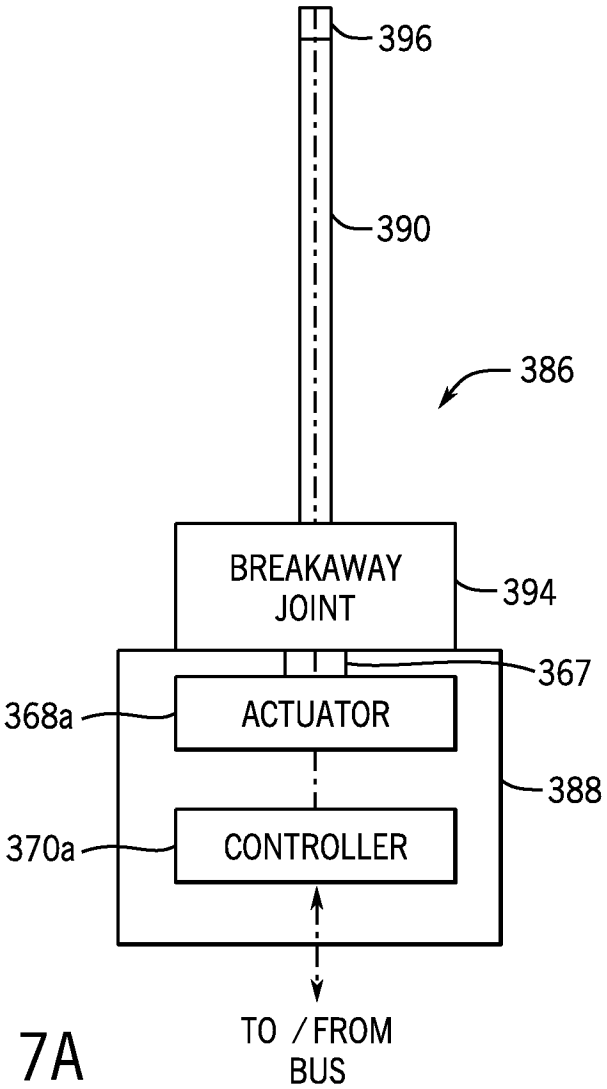
FIG. 7A illustrates a second example of an antenna or light for a marine vessel in an extended configuration.

FIGS. 7A and 7B show another example in which the peripheral device 66*a* is an antenna or light 386. However, in this example, the antenna/light 386 is retractable by pivoting the movable part 390 thereof with respect to the stationary part 388 thereof. If the peripheral device is an antenna, the movable part 390 can be the antenna itself. If the peripheral device is an all-around light, the movable part 390 can be a pole atop which the light is mounted. The contact-sensitive detector 396, breakaway joint 394, actuator 368*a*, and controller 370*a* all function substantially the same as described hereinabove with respect to their corresponding parts, although the actuator 368*a* may particularly be a rotary actuator suitable for providing the mentioned pivoting motion. The controller 370*a* may be configured the same as the controller 270*a* of FIGS. 6A and 6B, with respect to the actions the controller 370*a* takes in response to information from sensors 74, 76, 78 on the marine vessel 10.

In still another example, the peripheral device is a camera 20. The camera 20 could be retractable inside a recess 92 in a stationary part 88 as shown in FIGS. 4A and 4B, or could be situated on top of a pole-like movable part 290*a*, 390 as shown in FIGS. 6A, 6B and 7A, 7B, respectively. In such an embodiment, the sensor may be a navigational sensor 74 (such as the GPS receiver 24). When the navigational sensor 74 senses that the marine vessel 10 is in a geographical location of a marina or dock, the camera 20 may be extended from the recess 92 and turned on, and thereafter used as part of an autodocking strategy or similar automated or partially automated maneuvering strategy. The camera 20 can be automatically turned off and retracted in response to the navigational sensor 74 determining that the marine vessel 10 is no longer near the marina. Similarly, when the peripheral device is the camera 20, the sensor may be one inside a joystick. In response to actuation of the joystick, the camera 20 may be extended from the recess 92 and turned on, and thereafter used as part of a semi-automated maneuvering strategy that prevents the marine vessel 10 from colliding with other boats or the dock. The camera 20 can be automatically turned off and retracted in response to the sensor determining that the joystick has not been maneuvered for a predetermined period of time.

Note that the camera 20 shown in FIG. 1, the light 86 shown in FIGS. 4A and 4B, the cleat 186 shown in FIGS. 5A and 5B, and the light or antenna 286, 386 shown in FIGS. 6A-7B all include controllers. In some examples, each controller 70*a*, 170*a*, 270*a*, 370*a* is configured to control movable parts of additional peripheral devices of the same type by signal communication via a serial bus. Referring back to FIG. 2, the controllers in each of the camera 20, light 86, cleat 186, and antenna/light 286, 386 may act as master controllers that control other peripheral devices of the same type via the serial bus 62. That is, if the controller 70*a* in the light 86 of FIGS. 4A and 4B determines that the movable part 90 of the light 86 should be extended and turned ON based on any of the criteria noted herein above (for example, ambient lighting conditions), the controller 70*a* can command the actuators 68*b*, 68*c*in the other peripheral devices 66*b*, 66*c* (i.e., in other lights) to extend and turn ON also. The same goes for the cleat 186 of FIGS. 5A and 5B, which may have a master controller 170*a* that controls actuators in numerous other cleats, and the antenna or light 286, 386 of FIGS. 6A and 6B or 7A and 7B, which may have a master controller 270*a*, 370*a* that controls actuators in numerous other antennas or lights, respectively. In other examples, each camera, light, cleat, or antenna on the marine vessel 10 is provided with its own controller 70*a*, which activates the actuator 68*a* in response to information provided thereto via the serial bus 40 and/or 58.

In other examples, the camera 20, lights 86, 286, 386, cleats 186, and antennas 286, 386 may be extendable and retractable in response to operator input. For instance, the operator may utilize the MFD or keypad 51, a remote control, an application on a smart device, or other input device, which may be coupled to one of the serial buses 40, 58 or which may wirelessly communicate with the controller 70*a*. The controller 70*a* may be configured to activate the actuator 68*a* to extend or retract the movable part of the peripheral device in response to such operator input.

In still other examples, the camera 20, lights 86, 286, 386, cleats 186, and antennas 286, 386 may be extendable and retractable in response to information from the cloud 44 retrieved via the TCM 42. For example, weather data for the geographical region can be used to determine whether a light should be extended and turned ON. Crowd-sourced information from other boaters regarding areas with low overhead obstructions can be used to create a geo-fence in which an antenna or light needs to be retracted to avoid damage thereto. Furthermore, a boater may be able to use the MFD or keypad 51 or a "smart" device application to enter this type of data for retrieval and use by other boaters. For example, a user can choose to mark the location of a low overhead obstruction for later retrieval by a controller controlling an antenna or all-around light, or a user can choose to mark the location of a private dock for later retrieval by a controller controlling a cleat. These locations could be stored in the storage system of the controller, in the cloud 44, or in the memory of the MFD.

In each of the above examples, the controller 70*a*, 170*a*, 270*a*, 370*a* may require that the peripheral device 66*a* is retracted before activating the actuator 68*a*, 168*a*, 268*a*, 368*a* to extend the movable part of the peripheral device 66*a*. Similarly, the controller 70*a*, 170*a*, 270*a*, 370*a* may require that the peripheral device 66*a* is extended before activating the actuator 68*a*, 168*a*, 268*a*, 368*a* to retract the movable part of the peripheral device 66*a*. For example, the controller 70*a*, 170*a*, 270*a*, 370*a* can store its previous direction of actuation in its storage system or can be programmed to read the state of a switch therein. In other examples, the controller 70*a*, 170*a*, 270*a*, 370*a* will activate the actuator 68*a*, 168*a*, 268*a*, 368*a* to extend or retract the movable part 90, 190, 290, 390 in response to information from the above-noted sensors, in response to information from the cloud 44, and/or in response to operator input regardless of the extended or retracted state of the peripheral device, in which case limit switches are used to prevent the actuator 68*a*, 168*a*, 268*a*, 368*a* from further movement in one direction or the other.

Thus, the present disclosure contemplates a peripheral device 66*a* for a marine vessel, such as a camera 20, light 86, 286, 386, cleat 186, or antenna 286, 386, which comprises a movable part 90, 190, 290*a-c*, 390 configured to be extended away from or out of a stationary part 88, 188, 288, 388 thereof and retracted toward or into the stationary part 88, 188, 288, 388. The peripheral device includes an actuator 68*a*, 168*a*, 268*a*, 368*a* configured to extend and retract the movable part 90, 190, 290*a-c*, 390. The peripheral device includes a controller 70*a*, 170*a*, 270*a*, 370*a* operatively connected to the actuator 68*a*, 168*a*, 268*a*, 368*a* and configured to activate the actuator 68*a*, 168*a*, 268*a*, 368*a* to extend and retract the movable part 90, 190, 290*a-c*, 390 of the peripheral device in response to information from a sensor, such as a navigational sensor 74, a proximity sensor 76, an image sensor 78, a vessel speed sensor 80, or an ambient light sensor; in response to information from the cloud 44; and/or in response to operator input.

Figure 3:
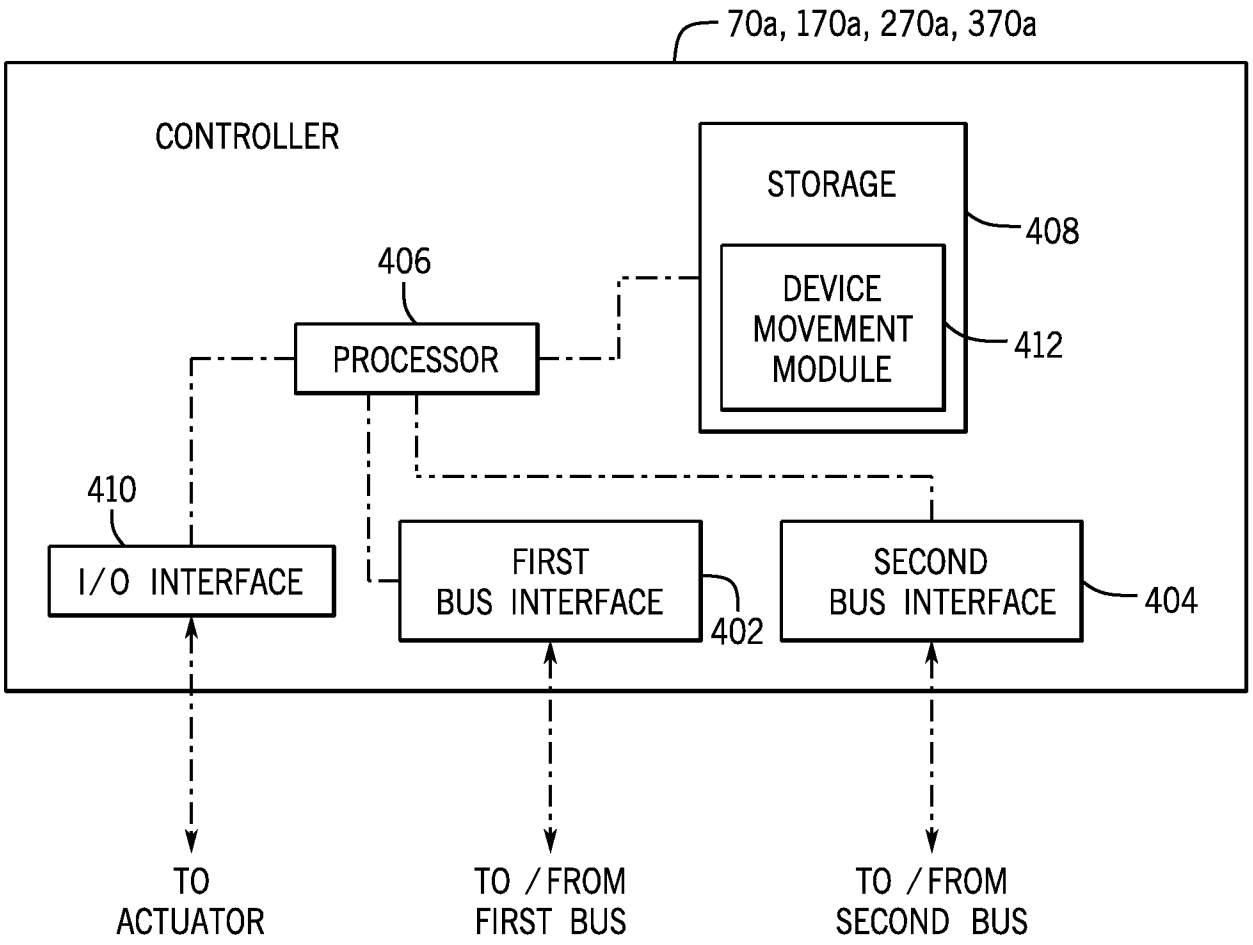
FIG. 3 illustrates one example of a controller for controlling an actuator in a peripheral device according to the algorithms of the present disclosure.

Now referring to FIG. 3, the controller 70*a*, 170*a*, 270*a*, 370*a* includes at least one transceiver for receiving information from the sensors 74, 76, 78, 80 via the serial bus 40 and/or 58. For example, briefly referring to FIG. 2 as well, the controller 70*a*, 170*a*, 270*a*, 370*a* has a bus interface 402 that is a CAN transceiver for communication with the CAN serial bus 58. If the controller 70*a*, 170*a*, 270*a*, 370*a* acts as a master controller to control actuators 68*b*, 68*c*in other peripheral devices 66*b*, 66*c* of the same type, the controller 70*a*, 170*a*, 270*a*, 370*a* also includes a second bus interface 404 that is a LIN transceiver for communication with the LIN serial bus 62.

The controller 70*a*, 170*a*, 270*a*, 370*a* also includes a processing system 406 and a storage system 408. The processing system 406 includes one or more processors, which may each be a microprocessor, a general-purpose central processing unit, an application-specific processor, a microcontroller, or any other type of logic-based device. The processing system 406 may also include circuitry that retrieves and executes software from the storage system 408. The processing system 406 may be implemented with a single processing device but may also be distributed across multiple processing devices or subsystems that cooperate in executing program instructions. The storage system 408 can comprise any storage media, or group of storage media, readable by the processing system 406, and capable of storing software. The storage system 408 may include volatile and non-volatile, removable and non-removable media implemented in any method or technology for storing information, such as computer-readable instructions, program modules comprising such instructions, data structures, etc. The storage system 408 may be implemented as a single storage device but may also be implemented across multiple storage devices or subsystems. Examples of storage media include random access memory, read only memory, optical discs, flash memory, virtual memory, and non-virtual memory, or any other medium which can be used to store the desired information and that may be accessed by an instruction execution system, as well as any combination of variation thereof. The storage media may be housed locally with the processing system 406, or may be distributed, such as distributed on one or more network servers, such as in cloud computing applications and systems. In some implementations, the storage media is non-transitory storage media. In some implementations, at least a portion of the storage media may be transitory.

The controller 70*a*, 170*a*, 270*a*, 370*a* also includes an input/output interface 410 that transfers information and commands to and from the processing system 406. In response to the processing system 406 carrying out instructions stored in a device movement module 412, the processing system 406 relays commands via the I/O interface 410 to the actuator 68*a*, 168*a*, 268*a*, 368*a* controlling the movement of the movable part 90, 190, 290*a-c*, 390 with respect to the stationary part 88, 188, 288, 388. Other input and/or output devices may also be connected to the I/O interface 410, and the examples shown and discussed herein are not limiting. The controller 70*a*, 170*a*, 270*a*, 370*a* also includes the above-noted transceiver/bus interface 402, by way of which the controller 70*a*, 170*a*, 270*a*, 370*a* is in signal communication with the bus 58, by way of which the controller 70*a*, 170*a*, 270*a*, 370*a* may be provided with information from the sensors 74, 76, 78, 80 and any operator input devices connected to the serial bus(es) 40 or 58.

The device movement module 412 is a set of software instructions executable to move the movable part 90, 190, 290*a-c*, 390 with respect to the stationary part 88, 188, 288, 388. The device movement module 412 may be a set of software instructions stored within the storage system 408 and executable by the processing system 406 to operate as described herein, such as to move the movable part 90, 190, 290*a-c*, 390 in response to information such as time of day, ambient light, geographical position, overhead obstructions, and/or vessel speed, as described herein above. As noted with respect to FIG. 2, the information can be determined from various sensors 74, 76, 78, 80 on the marine vessel 10, which may be in communication with the controller 70*a*, 170*a*, 270*a*, 370*a* via the serial bus(es) 40 and/or 58 and the bus interface 402. In another example, the controller 70*a*, 170*a*, 270*a*, 370*a* includes a wireless transceiver (not shown) capable of two-way wireless communication, and the sensors and devices communicate wirelessly with the controller 70*a*, 170*a*, 270*a*, 370*a*. Exemplary wireless protocols that could be used for this purpose include, but are not limited to, Bluetooth®, Bluetooth Low Energy (BLE), ANT, and ZigBee.

Those having ordinary skill in the art know that information from navigational sensors and vessel speed sensors is already generally readily available on many marine vessels, and such sensors are already connected to the main NMEA backbone in order to provide information to the MFD and engine/motor control unit. Furthermore, increasingly more marine vessels are being equipped with proximity sensors and/or cameras, which are also connected to the main NMEA backbone and provide information used to maneuver the marine vessel 10, including according to autonomous or semi-autonomous docking algorithms. Thus, such existing sensors can be used to provide information to the above-noted peripheral devices on a marine vessel 10 in order to enhance their functioning, ensure that a boat complies with local regulations, and/or enhance the aesthetics of the boat itself. The peripheral devices themselves do not require sensors in order to obtain such information, thereby reducing manufacturing complexity and cost to the consumer. Meanwhile, further reductions in complexity and cost can be realized by using one peripheral device with a master controller to control actuators in other peripheral devices of the same type.

In the present description, certain terms have been used for brevity, clarity, and understanding. No unnecessary limitations are to be implied therefrom beyond the requirement of the prior art because such terms are used for descriptive purposes only and are intended to be broadly construed. The different components and assemblies described herein may be used or sold separately or in combination with other components and assemblies. Various equivalents, alternatives, and modifications are possible within the scope of the appended claims.

What is claimed is:

1. A system for a marine vessel, the system including:

a peripheral device including an actuator configured to move a movable part of the peripheral device between a retracted position and an extended position;

a first serial bus configured to connect the peripheral device to other peripheral devices;

a controller located on or in the peripheral device, operatively connected to the actuator, and in signal communication with the first serial bus;

a sensor coupled to the controller via a second serial bus; and a breakaway joint provided between the movable part of the peripheral device and the actuator and the controller;

wherein the controller is configured to activate the actuator to move the movable part of the peripheral device from the extended position to the retracted position and from the retracted position to the extended position in response to information from the sensor; and wherein the breakaway joint is configured such that if force above a predetermined threshold is applied to the movable part of the peripheral device, the movable part of the peripheral device will pivot or partially or completely break off from the actuator and the controller.

2. The system of claim 1, further comprising another peripheral device of the same type and including an actuator coupled to the controller via the first serial bus, wherein the controller acts as a master controller and controls the actuators of both peripheral devices.

3. The system of claim 1, wherein the peripheral device comprises a contact-sensitive detector in communication with the controller, wherein the controller is configured to control the actuator to retract the movable part of the peripheral device in response to the contact-sensitive detector detecting contact while the actuator is extending the movable part of the peripheral device.

4. The system of claim 1, wherein the peripheral device is an antenna, a light, a cleat, or a camera.

5. The system of claim 1, wherein the peripheral device is a cleat, and the cleat comprises a light.

6. The system of claim 1, wherein the sensor is a navigational sensor, a proximity sensor, an image sensor, or a vessel speed sensor.

7. The system of claim 1, wherein the peripheral device is an antenna, a masthead light, or an all-around light, and the sensor is a proximity sensor, and wherein the controller is configured to activate the actuator to retract the movable part of the antenna, the masthead light, or the all-around light in response to the proximity sensor sensing an obstruction ahead of and above the marine vessel.

8. The system of claim 1, wherein the peripheral device is an antenna, a masthead light, or an all-around light, and the sensor is a navigational sensor, and wherein the controller is configured to activate the actuator to retract the movable part of the antenna, the masthead light, or the all-around light in response to the navigational sensor sensing that the marine vessel is in a geographical location of a low overhead obstruction.

9. The system of claim 1, wherein the peripheral device is a cleat, and the sensor is a navigational sensor, and wherein the controller is configured to activate the actuator to extend the movable part of the cleat in response to the navigational sensor sensing that the marine vessel is in a geographical location of a marina or dock.

10. The system of claim 1, wherein the peripheral device is a cleat, and the sensor is a vessel speed sensor, and wherein the controller is configured to activate the actuator to retract the movable part of the cleat in response to the vessel speed sensor sensing a speed of the marine vessel that is above a predetermined threshold speed.

11. A peripheral device for a marine vessel, the peripheral device comprising:

a movable part configured to be extended away from or out of a stationary part of the peripheral device and retracted toward or into the stationary part;

an actuator located on or in the stationary part and configured to extend and retract the movable part;

a controller located on or in the stationary part, operatively connected to the actuator, and configured to activate the actuator to extend and retract the movable part of the peripheral device in response to information from a sensor; and a breakaway joint between the movable part of the peripheral device and the actuator and the controller;

wherein the controller includes a transceiver for receiving information from the sensor via a serial bus; and wherein the breakaway joint is configured such that if force above a predetermined threshold is applied to the movable part of the peripheral device, the movable part of the peripheral device will pivot or partially or completely break off from the actuator and the controller.

12. The peripheral device of claim 11, further comprising a contact-sensitive detector in communication with the controller, wherein the controller is configured to control the actuator to retract the movable part of the peripheral device in response to the contact-sensitive detector detecting contact while the actuator is extending the movable part of the peripheral device.

13. The peripheral device of claim 11, wherein the controller is configured to control movable parts of additional peripheral devices.

14. The peripheral device of claim 11, wherein the peripheral device is an antenna, a masthead light, or an all-around light, and the sensor is a proximity sensor, and wherein the controller is configured to activate the actuator to retract the movable part of the antenna, the masthead light, or the all-around light in response to the proximity sensor sensing an obstruction ahead of and above the marine vessel.

15. The peripheral device of claim 11, wherein the peripheral device is an antenna, a masthead light, or an all-around light, and the sensor is a navigational sensor, and wherein the controller is configured to activate the actuator to retract the movable part of the antenna, the masthead light, or the all-around light in response to the navigational sensor sensing that the marine vessel is in a geographical location of a low overhead obstruction.

16. The peripheral device of claim 11, wherein the peripheral device is a cleat, and the sensor is a navigational sensor, and wherein the controller is configured to activate the actuator to raise the movable part of the cleat in response to the navigational sensor sensing that the marine vessel is in a geographical location of a marina or dock.

17. The peripheral device of claim 11, wherein the peripheral device is a cleat, and the sensor is a vessel speed sensor, and wherein the controller is configured to activate the actuator to retract the movable part of the cleat in response to the vessel speed sensor sensing a speed of the marine vessel that is above a predetermined threshold speed.

18. The peripheral device of claim 11, wherein the stationary part of the peripheral device comprises the breakaway joint.

19. The peripheral device of claim 11, wherein the movable part of the peripheral device comprises the breakaway joint.

* * * * *